US006052926A

United States Patent [19]

Stephens

[11] Patent Number: 6,052,926

[45] Date of Patent: Apr. 25, 2000

[54] BUCKET FOR A MATERIAL HANDLING APPARATUS

[76] Inventor: E. Rodney Stephens, 6 Dorothy St., Enfield, Conn. 06082

[21] Appl. No.: 09/161,973

[22] Filed: Sep. 28, 1998

Related U.S. Application Data

[60] Provisional application No. 60/062,580, Oct. 17, 1997.

[51] Int. Cl.[7] ..... E02F 3/40

[52] U.S. Cl. ..... 37/444; 37/901

[58] Field of Search ..... 37/444, 445, 901, 37/416, 418, 903; D15/32; 414/722, 725

[56] References Cited

U.S. PATENT DOCUMENTS

| | | | |
|---|---|---|---|
| 1,653,905 | 12/1927 | Harrison | 37/444 |
| 2,719,641 | 10/1955 | Pilch | 37/444 |
| 2,812,872 | 11/1957 | Perkins et al. | 37/444 |
| 2,853,201 | 9/1958 | Davidson et al. | 37/901 |
| 2,939,595 | 6/1960 | Waite | 37/901 |
| 3,092,920 | 6/1963 | Benno | 414/725 |
| 3,195,747 | 7/1965 | Kashergen . | |
| 3,229,835 | 1/1966 | Watts | 37/901 |
| 3,380,604 | 4/1968 | Leese | 37/901 |
| 3,421,236 | 1/1969 | Moyer | 414/725 |
| 3,581,924 | 6/1971 | Marz | 214/767 |
| 3,921,316 | 11/1975 | Moreau | 37/444 |
| 5,184,933 | 2/1993 | Pei-qian et al. | 414/725 |
| 5,416,990 | 5/1995 | Otwell . | |
| 5,526,591 | 6/1996 | Otwell . | |

FOREIGN PATENT DOCUMENTS

| | | | |
|---|---|---|---|
| 719415 | 10/1965 | Canada | 37/82 |
| 3231551 | 10/1965 | Germany | 37/443 |

*Primary Examiner*—Thomas B. Will
*Assistant Examiner*—Kristine M. Markovich
*Attorney, Agent, or Firm*—Presseisen & Reidelbach, P.C.; Charles F. Reidelbach, Jr.

[57] ABSTRACT

A bucket for a material handling apparatus which includes a bottom wall, a top wall and a pair of parallel side walls which connect the top wall to the bottom wall. The walls of the bucket define a housing having a chamber, a front opening and a rear opening. A divider plate is mounted to the side walls for pivotal movement about a horizontal axis between the front and rear openings. The bottom wall of the housing has an upper surface which is radial from the horizontal axis. The lower end of the divider plate remains close to the upper surface in all positions between a stop at the front opening and a stop at the rear opening.

4 Claims, 2 Drawing Sheets

BUCKET FOR A MATERIAL HANDLING APPARATUS

CROSS-REFERENCE TO RELATED APPLICATIONS

This application claims the benefit under 35 U.S.C. §119 (e) of prior U.S. Provisional Application Ser. No. 60/062,580, filed Oct. 17, 1997; which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed to a bucket for use on a material handling apparatus such as an excavating tractor or backhoe.

Many types of hydraulically-operated tools have been developed for material handling tractors such as backhoes and dipper stick shovels. Buckets are used with a dipper stick shovel for scooping particulate material in a forward direction and with a backhoe for scooping material in a rearward direction. In either case, the bucket is hydraulically actuated from the scooping position to a raised position and then tilted about a horizontal axis for depositing material in the bucket to another location or into the receptacle of a truck. Each type of bucket is designed for specific tasks. The unidirectional function of each bucket renders it awkward for precise manipulation of material. This problem becomes more acute when digging earth which contains relatively large rocks. The leading edge at the opening of the bucket provides a single line of attack. The opposite or closed end of the bucket may sometimes be used like a hammer to loosen a large rock which has proven to be difficult to manipulate by the bucket in a conventional manner. However, any engagement of material by any portion of the bucket except the leading edge of the bucket has very limited functionality since only the leading edge adjacent the opening of the bucket is designed specifically for digging or scooping of material. A different angle of attack for the bucket can be achieved by repositioning the tractor. This is time consuming and obstructions may not permit repositioning of the tractor. For many type of excavating tasks, digging is very often a frustrating and time consuming process. A certain degree of versatility has been achieved by the use of a double ended bucket as shown in U.S. Pat. No. 3,195,747 of Kashergen. The bucket in this patent has a front opening and a rear opening. A plate is pivotally connected to the upper end of the bucket housing near the front opening of the bucket. The plate is biased towards a stop at the front opening and effectively closes the front opening. This arrangement enables the bucket to be used as a conventional backhoe bucket. The bucket can also be used as a shovel, but in a limited capacity. As earth is scooped into the bucket through the front opening, the plate is pushed toward the rear opening and away from the bottom surface of the bucket. Since material that is scooped into the front opening of the bucket can exit the bucket through the rear opening of the bucket, only a fraction of the capacity of the bucket can be utilized when the bucket is used in the shovel mode. These and other difficulties associated with prior art buckets has been obviated by the present invention.

It is, therefore, a principal object of the present invention to provide a bucket for an earth handling apparatus which can be used effectively in a forward shovel mode and in a backward backhoe mode.

Another object of this invention is the provision of a bucket which can be used to dig a trench and deposit bedding stone in a single operation.

A further object of the present invention is the provision of a bucket which is substantially more versatile than conventional buckets for handling different tasks and for enabling each task to be handled more efficiently than prior art buckets.

With these and other objects in view, as will be apparent to those skilled in the art, the invention resides in the combination of parts set forth in the specification and covered by the claims appended hereto.

BRIEF SUMMARY OF THE INVENTION

The invention consists of a bucket for a material handling apparatus. The bucket includes a housing having a bottom wall, a top wall and a pair of spaced parallel side walls which connect the top wall to the bottom wall. The housing contains a chamber having a front opening and a rear opening. A divider plate is pivotally mounted to the side walls for movement about a horizontal axis between the front and rear openings. More specifically, the bottom wall has digging teeth and a stop at each of the front and rear openings.

BRIEF DESCRIPTION OF THE DRAWINGS

The character of the invention, however, may be best understood by reference to one of its structural forms, as illustrated by the accompanying drawings in which.

DETAILED DESCRIPTION OF THE INVENTION

Figure 1:
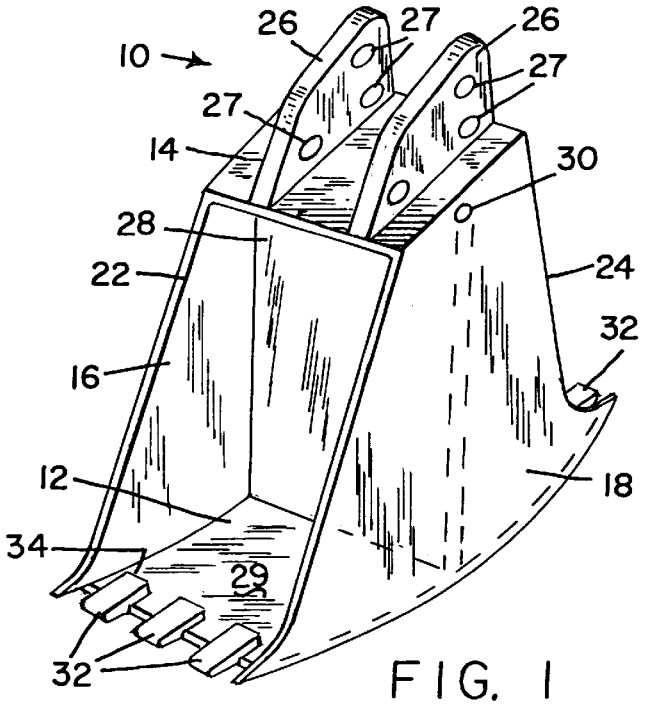
FIG. 1 is an isometric view of a material handling bucket embodying the principles of the present invention.
Figure 2:
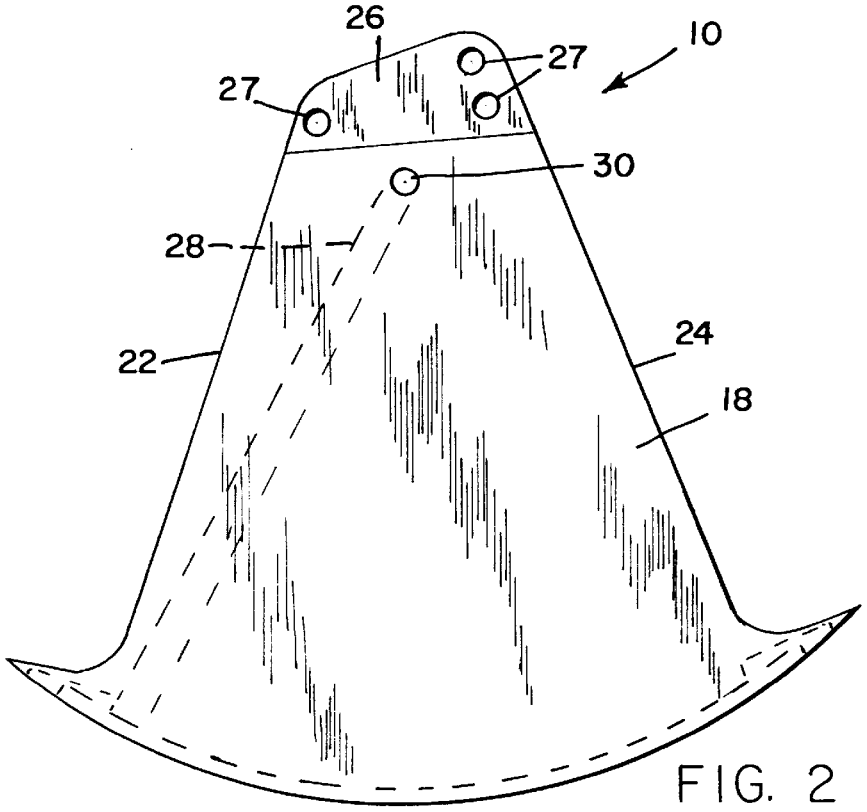
FIG. 2 is a side elevational view of the bucket.
Figure 3:
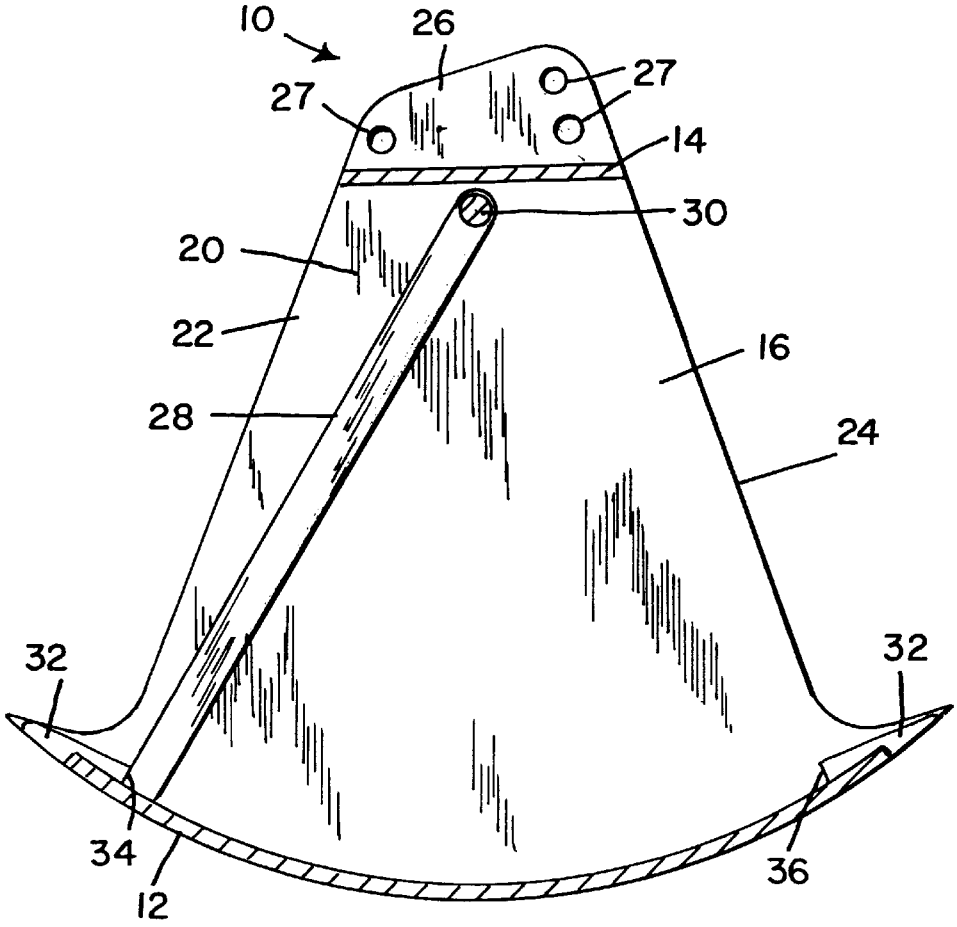
FIG. 3 is a side elevational view of the bucket with one of the side wall broken away.

Referring to FIGS. 1–3, the two-way bucket of the present invention is generally indicated by the reference numeral 10 and consists of a bottom wall 12, a top wall 14 and pair of side walls 16 and 18. The walls of the bucket define a chamber, generally indicated by the reference numeral 20, which has a front opening 22 and a rear opening 24. Mounting brackets 26 are fixed to the top wall 14 and are provided with apertures 27 for attachment to the articulated operating arms of a backhoe or to the dipper stick of a dipper stick shovel.

A divider plate 28 is located within the chamber 20. The upper end of the divider plate 28 is pivotally mounted on a shaft 30 which is supported between the side walls 16 and 18. The lower end of the divider plate 28 is positioned above the bottom wall 12 with enough clearance from the upper surface 29 of the bottom wall 12 so that the divider plate is able to swing freely between the front opening 22 and the rear opening 24. The upper surface of the bottom wall 12 is concave, having a radius from the center of the shaft 30. The bottom wall 12 also has digging teeth 32 at the front and rear openings of the bucket. The bottom wall 12 has a upwardly extending front stop 34 which limits the forward motion of the divider plate 28 and upwardly extending rear stop 36 which limits the rearward motion of the divider plate 28.

When attached to a backhoe, the bucket 10 of the present invention can be used in a forward direction as a dipper stick shovel, or in a rearward direction in conventional backhoe fashion. When the bucket is used in the forward direction, material which is scooped up to the front opening 22 of the bucket, pushes the divider plate 28 to its rearward position against the rear stop 36. When the bucket 10 is used in the rearward direction, materials scooped up through the rear opening 24 pushes the divider plate 28 forwardly towards the front stop 34.

The bucket 10 of the present invention has substantially greater versatility than conventional buckets for digging the moving earth, stones, and other material in loading material into trucks. Examples of the versatility of the bucket 10 can be illustrated in the following examples of excavation projects:

1. The bucket 10 of the present invention can be utilized to install bedding stone in a single step. In this situation, the bedding stone to be installed is picked up through the rear opening 24 of the bucket so that it lies within the chamber 20 at the rear end of the bucket. The bucket is then used as a shovel to dig a trench, wherein earth is scooped up through the front opening 22. The earth forces the divider plate 28 rearwardly, thereby pushing the stone out of the chamber 20 through the rear opening 24. The stone is thereby effectively deposited in the void which was created in the ground when earth was scooped up into the chamber through the front opening 22.
2. The fact that the digging force of the bucket of the present invention can be used in both directions is particularly useful for rock and mass excavation projects. In rock excavation, the rocks usually have to be worked from different angles to loosen the rocks. This can be accomplished with the bucket of the present invention with little or no movement of the backhoe. In digging trenches, the versatility of the bucket enables the loading truck to be positioned very close to the backhoe, thereby increasing efficiency and decreasing loading time.

A modified version of the bucket of the present invention without digging teeth can also function very effectively as a clean-up bucket. The modified bucket enables material to be scooped up, deposited and distributed more efficiently than conventional backhoe buckets, or shovel buckets.

What is claimed is:

1. A bucket for handling material comprising:

(a) a housing having a bottom wall, a pair of spaced side walls, and a top wall forming with said side walls and said bottom wall an enclosure having a front opening and a rear opening;

(b) at least one bracket fixed to said housing for enabling said bucket to be connected to an excavation machine;

(c) a plate extending between said side walls and having an upper end connected to said housing adjacent said top wall for guided free pivoting movement about a horizontal axis within said enclosure between said front opening and said rear opening, said plate having a bottom end;

(d) a front stop fixed to said housing adjacent said front opening for limiting the pivoting movement of said plate toward said front opening;

(e) a rear stop fixed to said housing adjacent said rear opening for limiting the pivoting movement of said plate toward said rear opening;

(f) a first plurality of digging teeth fixedly connected to said bottom wall along said front opening said digging teeth projecting outward from said front opening;

(g) a second plurality of digging teeth fixedly connected to said bottom wall along said rear opening said digging teeth projecting outward from said rear opening; and (h) said bottom wall having a concave upper surface which is radial about said horizontal axis from said front opening to said rear opening, the bottom end of said plate being substantially close to said bottom surface in all positions of said plate relative to said housing between said front opening and said rear opening, whereby said plate divides material within said bucket.

2. The bucket for handling material as recited in claim 1, wherein the upper end of said plate is pivotally connected to said side walls, such that said upper end of said plate is positioned equidistant from said front opening and said rear opening.

3. The bucket for handling material as recited in claim 1, wherein said front stop and said rear stop are formed by said digging teeth.

4. A bucket for handling material comprising:

(a) a housing having a bottom wall, a pair of spaced side walls, and a top wall forming with said side walls and said bottom wall an enclosure having a front opening and a rear opening, said bottom wall having an upper surface;

(b) at least one bracket fixed to said housing for enabling said bucket to be connected to an excavation machine;

(c) a plate extending between said side walls and mounted for guided free movement within said enclosure between said front opening and said rear opening;

(d) a front stop fixed to said housing adjacent said front opening for limiting the movement of said plate toward said front opening;

(e) a rear stop fixed to said housing adjacent said rear opening for limiting the movement of said plate toward said rear opening; and (f) said plate having a bottom end which is substantially close to the upper surface of said bottom wall in all positions of said plate relative to said housing between said front opening and said rear opening, whereby said plate divides material within said bucket.

* * * * *